US006408465B1

(12) United States Patent
Fleming

(10) Patent No.: US 6,408,465 B1
(45) Date of Patent: Jun. 25, 2002

(54) PORTABLE MASSAGE TABLE

(76) Inventor: Robert J. Fleming, 2422 Swifton Ct., Las Vegas, NV (US) 89104

( * ) Notice: Subject to any disclaimer, the term of this patent is extended or adjusted under 35 U.S.C. 154(b) by 0 days.

(21) Appl. No.: 09/702,970

(22) Filed: Oct. 31, 2000

(51) Int. Cl.[7] ..... A47B 7/00

(52) U.S. Cl. ..... 5/620; 5/622; 5/638; 5/725; 606/242

(58) Field of Search ..... 5/600, 620, 622, 5/638, 725; 606/242, 243, 244; 108/90, 92, 97

(56) References Cited

U.S. PATENT DOCUMENTS

| | | | | | |
|---|---|---|---|---|---|
| 1,096,595 | A | * | 5/1914 | Brown et al. | 5/620 |
| 1,230,592 | A | | 6/1917 | Montaney | |
| 1,710,400 | A | | 4/1929 | Bebout | |
| 2,533,787 | A | | 12/1950 | Gebhart | |
| 2,631,303 | A | * | 3/1953 | Valentine | 5/111 |
| 2,810,920 | A | * | 10/1957 | Carruth | 5/725 |
| 4,122,567 | A | * | 10/1978 | Hanson | 5/722 |
| 4,244,066 | A | * | 1/1981 | Rukawina | 5/691 |
| 4,333,638 | A | * | 6/1982 | Gillotti | 108/36 |
| 4,590,632 | A | * | 5/1986 | Meyer | 5/694 |
| 5,468,216 | A | * | 11/1995 | Johnson et al. | 606/242 |
| 5,642,542 | A | | 7/1997 | Kometani | |
| 5,946,749 | A | * | 9/1999 | Sewell | 5/725 |
| 5,947,955 | A | * | 9/1999 | Thomas | 606/243 |
| 6,042,184 | A | * | 3/2000 | Kofoed | 297/391 |
| 6,047,750 | A | * | 4/2000 | Jensen | 108/97 |

* cited by examiner

*Primary Examiner*—Jack Lavinder
*Assistant Examiner*—James M. Hewitt
(74) *Attorney, Agent, or Firm*—Henderson & Sturm LLP

(57) ABSTRACT

A portable massage table including a planar padded base having a centrally located concave first notch in one end, and a planar padded extension that has an aligned second notch. The extension is slidably movable with respect to the base between a first position where the base and extension are aligned so that the first and second notches form a small face opening, and a second position where the base and extension are spaced apart and the first and second notches form a large face opening. One end of the base is supported by foldable legs that are telescopically adjustable in height, while the other end of the base is supported by a conventional bed.

7 Claims, 1 Drawing Sheet

PORTABLE MASSAGE TABLE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of massage accessories, and more particularly to a portable massage table.

2. Description of Related Art

As can be seen by reference to the following U.S. Pat, Nos. 1,230,592; 1,710,400; 2,533,787 and 5,642,542, the prior art is replete with myriad and diverse massage and chiropractic tables.

While all of the aforementioned prior art constructions are more than adequate for the basic purpose and function for which they have been specifically designed, they are uniformly deficient with respect to their failure to provide a simple, efficient, and practical portable massage table having an adjustable face opening.

As a consequence of the foregoing situation, there has existed a longstanding need for a new and improved portable massage table and the provision of such a construction is a stated objective of the present invention.

BRIEF SUMMARY OF THE INVENTION

Briefly stated, the present invention provides a portable massage table including a planar padded base having a centrally located concave first notch in one end, and a planar padded extension that has an aligned second notch. The extension is slidably movable with respect to the base between a first position where the base and extension are aligned so that the first and second notches form a small face opening, and a second position where the base and extension are spaced apart and the first and second notches form a large face opening. One end of the base is supported by foldable legs that are telescopically adjustable in height, while the other end of the base is supported by a conventional bed.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
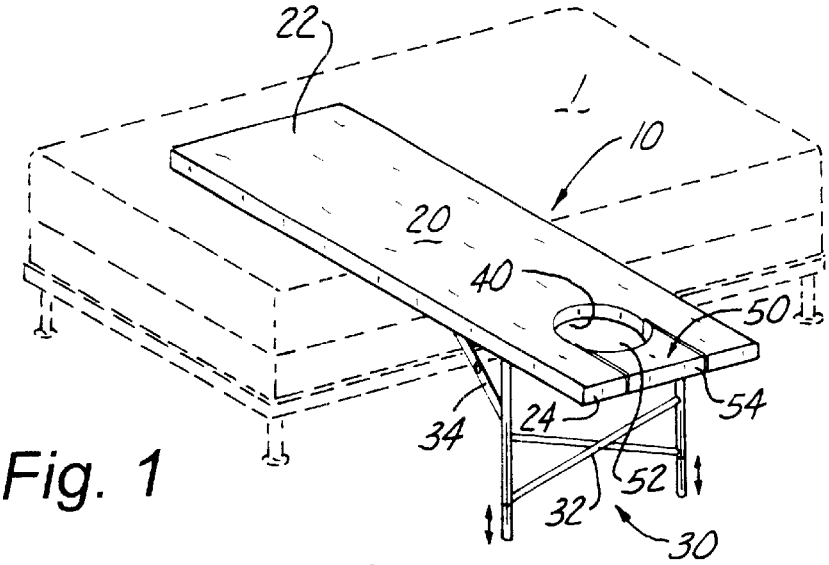
FIG. 1 is a perspective view of the portable massage table of the present invention with one end support on a conventional bed and the other end supported by foldable adjustable legs.
Figure 3:
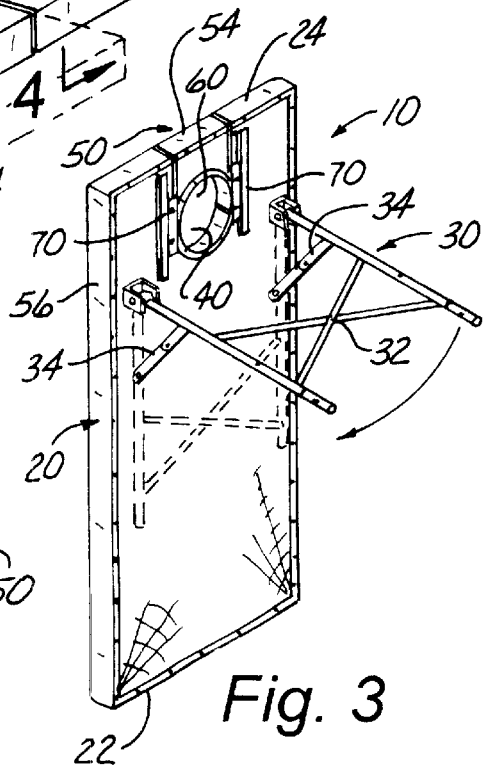
FIG. 3 is a perspective view of the underside of the table illustrating the operation of the foldable legs.
Figure 4:
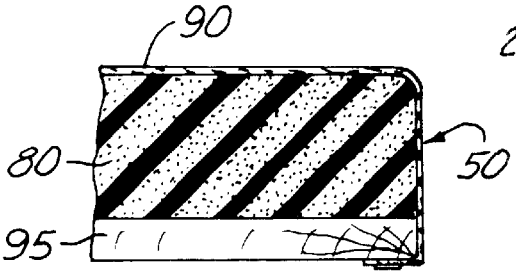
FIG. 4 is an enlarged sectional view taken along line 4—4 of FIG. 2 showing the foam padding of the table with a vinyl covering.

As can be seen by reference to the drawings, and in particularly to FIG. 1, the portable massage table that forms the basis of the present invention is designated generally by the reference number 10. The table 10 includes a planar base 20, having a first end 22 supported on a conventional bed 1, and a second end 24 supported by legs 30 that are telescopically adjustable in height as indicated by the directional arrows in FIG. 1. The legs 30 are also movable between an extended position perpendicular to the base 20, and a folded position parallel to the base 20 as indicated in dashed line in FIG. 3. The legs 30 are stabilized by cross supports 32 and are held in the extended position by locking braces 34.

Figure 2:
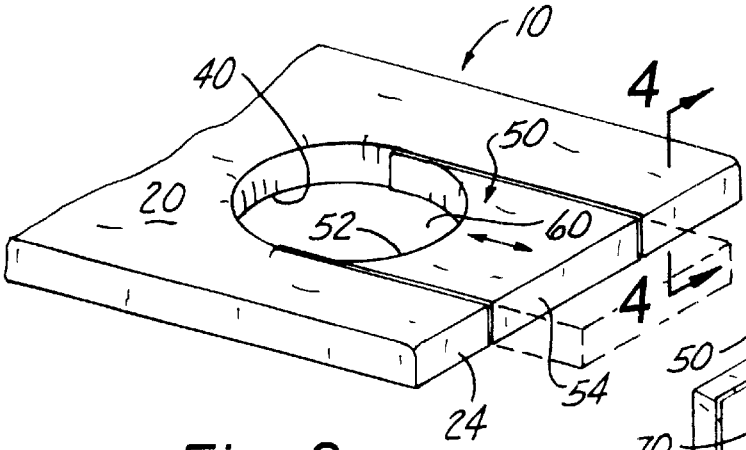
FIG. 2 is an enlarged perspective view illustrating the slidable adjustment of the extension with respect to the base.

The second end 24 at the base 20 has a centrally located concave first notch 40. An extension 50 includes a second notch 60 in its first end 52 that aligns with the first notch 40 to form the user's face opening. The extension 50 is slidably attached to the base 20 by telescoping rails 70. The extension 50 is movable between a first position where the second end 24 of the base 20 is aligned with the second end 54 of the extension 50 (FIGS. 1 and 3), and a second position when the second end 24 is spaced from the second end 54 (FIG. 2). The face opening is thus adjustable in size to allow comfort for children and adults alike.

Both the base 20 and the extension 50 carry a foam padding 80 with a vinyl covering 90 attached to a plywood board 95. The table 10 is simple in design and is much more affordable than other massage tables currently available. The user of the table 10 may receive massages in the privacy of their own bedroom with a low investment in equipment.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A massage table, comprising:

a planar base having a top surface, a bottom surface, a first end, and a second end having a centrally located concave first notch therein;

a planar extension slidably attached to the second end of the base, the extension having a top surface, a bottom surface, a first end having a centrally located concave second notch therein disposed in alignment with the first notch in the base, and a second end, the extension being movable between a first position wherein the second end of the base is aligned with the second end of the extension, and a second position wherein the second end of the base is spaced from the second end of the extension, whereby the first and second notches form a face opening of adjustable size;

wherein the first end of the base is disposed to be supported on a bed, and wherein legs attached to the bottom surface of the base are disposed to support the second end thereof; and wherein the legs are movable between an extended position disposed perpendicular to the base, and a folded position disposed parallel to the base.

2. The massage table of claim 1 wherein the legs are telescopically adjustable in length, whereby the second end of the base supported by the legs may be positioned at the same elevation as the first end of the base supported by the bed.

3. The massage table of claim 1 wherein the top surface of the base and the top surface of the extension carry a foam padding.

4. A massage table, comprising:

a planar base having a top surface, a bottom surface, a first end, and a second end having a centrally located concave first notch therein;

a planar extension slidably attached to the second end of the base, the extension having a top surface, a bottom surface, a first end having a centrally located concave second notch therein disposed in alignment with the first notch in the base, and a second end, the extension being movable between a first position wherein the second end of the base is aligned with the second end of the extension, and a second position wherein the second end of the base is spaced from the second end of the extension, whereby the first and second notches form a face opening of adjustable size;

wherein the bottom surface of the first end of the base is bare and is disposed to be supported on a bed, and wherein legs attached to the bottom surface of the base are disposed to support the second end thereof.

5. The massage table of claim 4 wherein the legs are movable between an extended position disposed perpendicular to the base, and a folded position disposed parallel to the base.

6. The massage table of claim 5 wherein the legs are telescopically adjustable in length, whereby the second end of the base supported by the legs may be positioned at the same elevation as the first end of the base supported by the bed.

7. The massage table of claim 4 wherein the top surface of the base and the top surface of the extension carry a foam padding.

* * * * *